US006244944B1

(12) United States Patent
Elledge

(10) Patent No.: US 6,244,944 B1
(45) Date of Patent: Jun. 12, 2001

(54) METHOD AND APPARATUS FOR SUPPORTING AND CLEANING A POLISHING PAD FOR CHEMICAL-MECHANICAL PLANARIZATION OF MICROELECTRONIC SUBSTRATES

(75) Inventor: Jason B. Elledge, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/387,190

(22) Filed: Aug. 31, 1999

(51) Int. Cl.[7] ..... B24B 21/00

(52) U.S. Cl. ..... 451/296; 451/41; 451/299; 451/307; 451/312; 451/324; 451/443

(58) Field of Search ..... 451/41, 296, 299, 451/307, 312, 324, 443

(56) References Cited

U.S. PATENT DOCUMENTS 6,068,542 * 5/2000 Hosokai ..... 451/37
6,086,460 * 7/2000 Labunsky et al. ..... 451/56
6,135,859 * 10/2000 Tietz ..... 451/41

* cited by examiner

*Primary Examiner*—Stephen F. Gerrity
*Assistant Examiner*—Shantese McDonald
(74) *Attorney, Agent, or Firm*—Dorsey & Whitney LLP

(57) ABSTRACT

A method and apparatus for supporting, cleaning and/or drying a polishing pad used for planarizing a microelectronic substrate. In one embodiment, the apparatus can include a cleaning head positioned adjacent a post-operative portion of the polishing pad to clean and/or dry the rear surface of the polishing pad. The cleaning head can include a heat source, a mechanical contact element, and/or orifices that direct fluid and/or gas toward the rear surface. The apparatus can further include a vessel through which the rear surface of the polishing pad passes to clean the rear surface. The apparatus can also include a flow passage in fluid communication with a region between the polishing pad and a support pad upon which the polishing pad rests during planarization. Gas moves through the flow passage toward or away from an interface region between the polishing pad and the support pad to draw the polishing pad toward or away from the support pad.

22 Claims, 6 Drawing Sheets

METHOD AND APPARATUS FOR SUPPORTING AND CLEANING A POLISHING PAD FOR CHEMICAL-MECHANICAL PLANARIZATION OF MICROELECTRONIC SUBSTRATES

TECHNICAL FIELD

The present invention is directed toward methods and apparatuses for supporting, cleaning and/or drying a polishing pad used for mechanical and/or chemical-mechanical planarization.

BACKGROUND OF THE INVENTION

Mechanical and chemical-mechanical planarizing processes (collectively "CMP") are used in the manufacturing process of microelectronic devices to form a flat surface on semiconductor wafers, field emission displays, and many other microelectronic-device substrates and substrate assemblies. FIG. 1 is a partially schematic, isometric view of a conventional web-format planarizing machine 10 that has a platen 20. A sub-pad 11 is attached to the platen 20 to provide a flat, solid workstation for supporting a portion of a web-format polishing pad 16 in a planarizing zone "A" during planarization. The polishing pad 16 has a rear surface 19 that engages the sub-pad 11 and a planarizing surface 18 facing opposite the rear surface 19 to planarize a substrate 12.

The planarizing machine 10 also has a pad-advancing mechanism, including a plurality of rollers, to guide, position and hold the polishing pad 16 over the sub-pad 11. The pad-advancing mechanism generally includes a supply roller 24, first and second idler rollers 21*a* and 21*b*, first and second guide rollers 22*a* and 22*b*, and a take-up roller 23. As explained below, a motor (not shown) drives the take-up roller 23 and the supply roller 24 to advance and retract the polishing pad 16 over the sub-pad 11 along a travel path T—T. The first idler roller 21*a* and the first guide roller 22*a* press an operative portion of the polishing pad 16 against the sub-pad 11 to hold the polishing pad 16 stationary during operation.

The planarizing machine 10 further includes a carrier assembly 30 to translate the substrate 12 over the polishing pad 16. In one embodiment, the carrier assembly 30 has a head 31 to pick up, hold and release the substrate 12 at appropriate stages of the planarizing process. The carrier assembly 30 also has a support gantry 32 and a drive assembly 33 that can move along the gantry 32. The drive assembly 33 has an actuator 34, a drive shaft 35 coupled to the actuator 34, and an arm 36 projecting from the drive shaft 35. The arm 36 carries the head 31 via a terminal shaft 37. The actuator 34 orbits the head 31 about an axis B—B (as indicated by arrow $R_1$) and can rotate the head 31 about an axis C—C (as indicated by arrow $R_2$) to move the substrate 12 over the polishing pad 16 while a planarizing fluid 17 flows from a plurality of nozzles 38 in the head 31. The planarizing fluid 17 may be a conventional CMP slurry with abrasive particles and chemicals that etch and/or oxidize the surface of the substrate 12, or the planarizing fluid 17 may be a non-abrasive planarizing solution without abrasive particles. In most CMP applications, conventional CMP slurries are used on conventional polishing pads, and planarizing solutions without abrasive particles are used on fixed-abrasive polishing pads.

In the operation of the planarizing machine 10, the carrier assembly 30 presses the substrate 12 against the planarizing surface 18 of the polishing pad 16 as the carrier head 31 moves the substrate 12 over the planarizing surface 18. The polishing pad 16 moves across the sub-pad 11 along the pad travel path T—T either during or between planarizing cycles to change the particular portion of the polishing pad 16 in the planarizing zone A. For example, the supply and take-up rollers 24, 23 can drive the polishing pad 16 between planarizing cycles such that a point P moves incrementally across the sub-pad 11 to a number of intermediate locations $I_1$, $I_2$, etc. Alternatively, the rollers 24, 23 may drive the polishing pad 16 between planarizing cycles such that the point P moves all the way across the sub-pad 11 toward the take-up roller 23 to completely remove a used or post-operative portion of the polishing pad 16 from the planarizing zone A. The rollers 24, 23 may also continuously drive the polishing pad 16 at a slow rate during a planarizing cycle such that the point P moves continuously across the sub-pad 11 during planarization.

The planarizing machine 10 can also include a planarizing surface cleaner 40 (shown schematically in FIG. 1) positioned between the platen 20 and the take-up roller 23 to clean the post-operative portion of the polishing pad 16. The planarizing surface cleaner 40 can include a brush 41 having bristles that contact the planarizing surface 18 of the polishing pad 16 and a liquid dispenser 42 positioned proximate to the brush 41 to dispense a cleaning liquid on the planarizing surface 18. Accordingly, the planarizing surface cleaner 40 can clean the post-operative portion of the polishing pad 16 as it moves off the platen 20 along the travel path T—T. Once the post-operative portion of the polishing pad 16 has been cleaned, it can be translated back onto the platen 20 along the travel path T—T and into the planarizing zone A for another planarizing cycle.

One drawback with the apparatus 10 shown in FIG. 1 is that the rear surface 19 of the polishing pad 16 can become contaminated with debris (such as liquid and/or particulate matter) during the planarizing process and/or the cleaning process. The debris can become trapped between the polishing pad 16 and the sub-pad 11, causing a local bump or other non-uniformity to form in the planarizing surface 18. The non-uniformity in the planarizing surface 18 can create a non-uniformity in the substrate 12 and/or can cause the polishing pad 16 to wear in a non-uniform manner.

A further drawback is that liquid on the rear surface 19 of the polishing pad 16 can form an adhesive bond between the polishing pad 16 and the sub-pad 11. The adhesive bond can inhibit relative movement between the polishing pad 16 and the sub-pad 11 when the polishing pad 16 moves along the travel path T—T. In one conventional method, the idler rollers 21*a*, 21*b* and/or the guide roller 22*a* move the polishing pad 16 normal to the upper surface of the sub-pad 11 to break the adhesive bond. However, the action of the rollers against the polishing pad 16 may not be effective to separate the polishing pad 16 from the sub-pad 11. Furthermore, if the polishing pad 16 is dragged over the sub-pad 11, the frictional contact between the two can abrade particulate matter from the polishing pad 16 and/or the sub-pad 11, which can cause a bump or other non-uniformity to form in the planarizing surface 18, as discussed above.

SUMMARY OF THE INVENTION

The present invention is directed toward methods and apparatuses for supporting, cleaning and/or drying a polishing pad used for mechanical and/or chemical planarization of microelectronic substrates and substrate assemblies. In one aspect of the invention, a cleaning head is positioned proximate to a post-operative portion of the polishing pad to remove material from a rear surface of the polishing pad that faces opposite a planarizing surface of the polishing pad. The cleaning head can have a cleaning device operable to remove liquid and/or particulate material from the rear surface. For example, the cleaning device can include a contact element such as an absorbent brush or an impermeable blade positionable to contact the rear surface of the post-operative portion of the polishing pad, an orifice facing toward the rear surface of the polishing pad to provide gas or liquid to the rear surface, and/or a heat source to dry the rear surface of the polishing pad. Alternatively, the cleaning head can include a vessel proximate to the post-operative portion of the polishing pad. The vessel can have an opening configured to receive the post-operative portion and an interior volume in fluid communication with the opening and configured to contain a quantity of cleaning liquid sufficient to contact the rear surface of the polishing pad. The vessel can further include an ultrasonic transducer to transmit ultrasonic energy to the cleaning liquid.

In an embodiment in accordance with still a further aspect of the invention, the polishing pad can be supported on a support surface, such as a surface of a support pad. Gas or liquid is directed toward or away from an interface region between the support surface and the rear surface of the polishing pad to separate the polishing pad from the support surface, or draw the polishing pad toward the support surface.

DETAILED DESCRIPTION OF THE INVENTION

The present invention is directed toward methods and apparatuses for supporting, cleaning and/or drying planarizing media used to planarize microelectronic substrates and/or substrate assemblies. Many specific details of certain embodiments of the invention are set forth in the following description and in FIGS. 2–6 to provide a thorough understanding of such embodiments. One skilled in the art, however, will understand that the present invention may have additional embodiments, or that the invention may be practiced without several of the details described in the following description.

Figure 1:
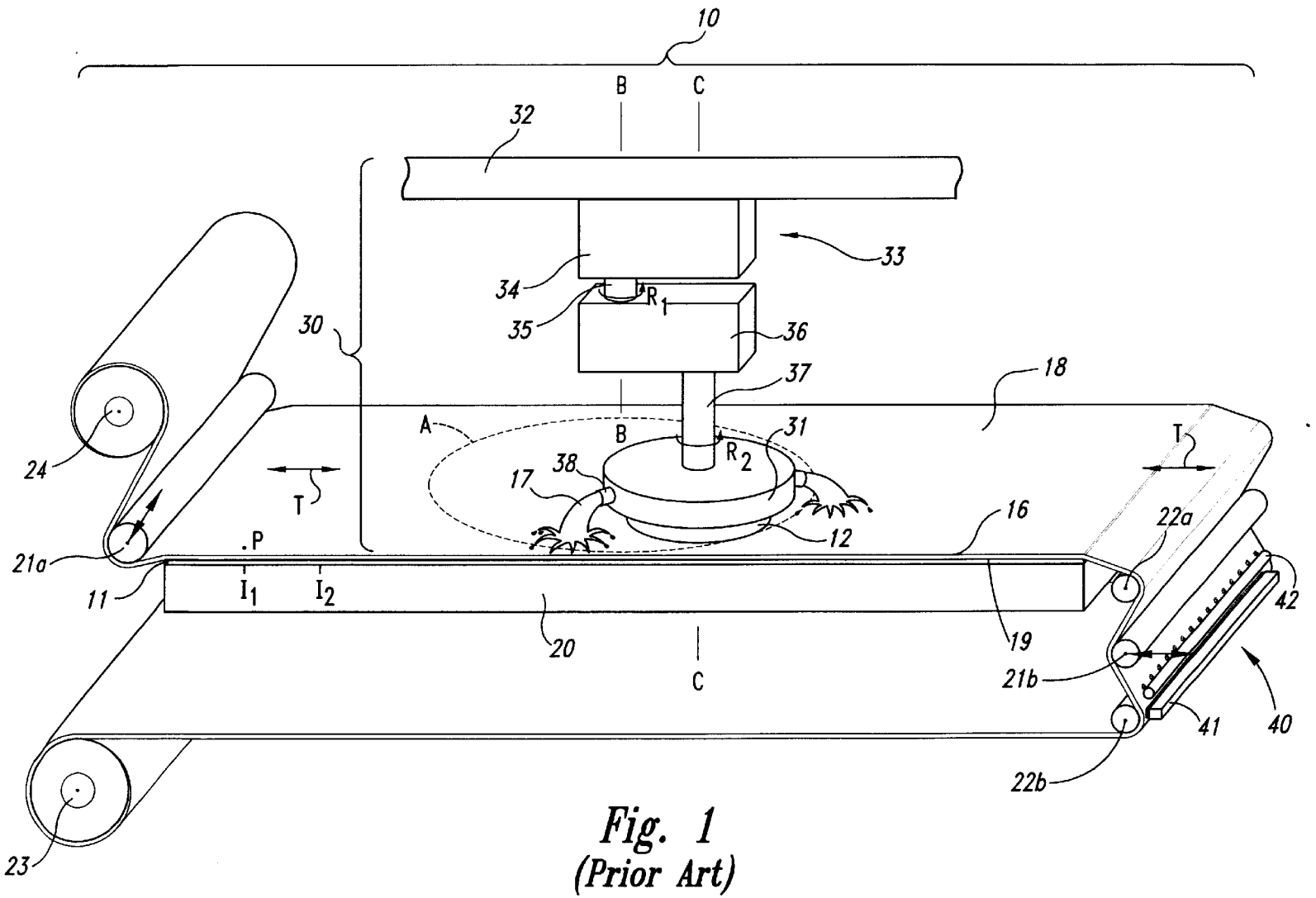
Fig. 1 (Prior Art)
FIG. 1 is a partially schematic, front isometric view of a web-format planarizing machine in accordance with the prior art.
Figure 2:
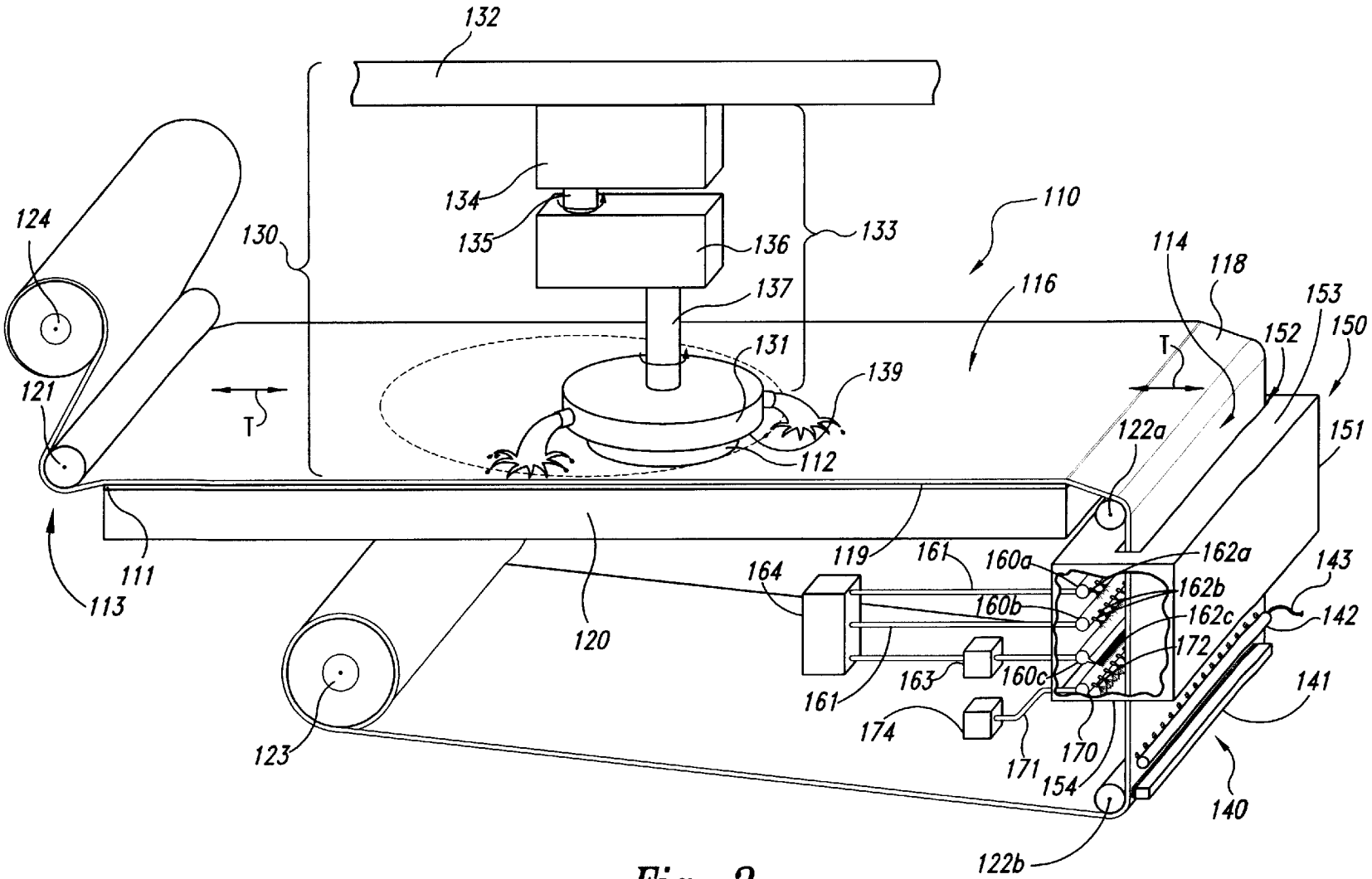
FIG. 2 is a partially schematic, partially broken, front isometric view of a planarizing machine having a cleaning head in accordance with an embodiment of the invention.

FIG. 2 is a partially schematic, side isometric view of planarizing machine 110 having a polishing pad 116 that passes through a cleaning head 150 and adjacent a planarizing surface cleaner 140 in accordance with an embodiment of the invention. The polishing pad 116 extends from a supply roller 124 across a platen 120 and a support pad 111 to a take-up roller 123, while being controlled and guided by an idler roller 121 and two guide rollers 122*a,* 122*b* generally as was discussed above. The polishing pad 116 has a planarizing surface 118 facing toward a microelectronic substrate or substrate assembly 112 and a rear surface 119 facing opposite the planarizing surface 118. A carrier assembly 130 positioned adjacent the polishing pad 116 can include a head 131 having an engaging surface 139 that presses the substrate 112 against the polishing pad 116 during operation. A drive assembly 133 supported by a gantry 132 and including an actuator 134, a drive shaft 135, an arm 136 and a terminal shaft 137 moves the head 131 relative to the polishing pad 116 to remove material from the substrate 112. The polishing pad 116 advances from the supply roller 124 to the take-up roller 123 either between or during planarizing cycles, in a manner generally similar to that discussed above.

The polishing pad 116 includes a pre-operative portion 113 between the supply roller 124 and the platen 120 and a post-operative portion 114 between the platen 120 and the take-up roller 123. As the polishing pad 116 advances along the travel path T—T toward the take-up roller 123, the pre-operative portion 113 moves onto the platen 120 to planarize the substrate 112 and the post-operative portion 114 moves off the platen 120 for cleaning. Accordingly, the planarizing surface cleaner 140 and the cleaning head 150 are positioned proximate to the post-operative portion 114 between the platen 120 and the take-up roller 123.

In one embodiment, the planarizing surface cleaner 140 includes a brush 141 having bristles that engage the planarizing surface 118 of the polishing pad 116 to remove particulates and other contaminants from the planarizing surface 118, or the planarizing surface cleaner 140 can include other cleaning elements. The planarizing surface cleaner 140 also includes a liquid dispenser 142 coupled with a conduit 143 to a source of cleaning liquid (not shown). The liquid dispenser 142 can have orifices facing toward the planarizing surface 118 to dispense the cleaning liquid onto the planarizing surface 118. The mechanical action provided by the brush 141 in combination with the chemical and/or mechanical action provided by the cleaning liquid clean the planarizing surface 118 of the post-operative portion 114 before the post-operative portion 114 returns to the platen 120 along the travel path T—T for the next planarizing cycle.

The cleaning head 150 is positioned between the planarizing surface cleaner 140 and the platen 120 to clean and/or dry the rear surface 119 of the polishing pad 116 before the post-operative portion 114 of the polishing pad 116 returns to the platen 120. The cleaning head 150 can include a body 151 with an upper surface 153, a lower surface 154 and a slot 152 extending through the body 151 from the upper surface 153 to the lower surface 154, or the cleaning head 150 can have other configurations to receive the polishing pad 116. In one embodiment, the cleaning head 150 includes a liquid manifold 170 positioned within the slot 152 and coupled to a liquid source 174 with a liquid conduit or passage 171. The liquid manifold 170 has one or more liquid orifices 172 pointing toward the rear surface 119 of the polishing pad 116 to direct the cleaning liquid toward the rear surface 119. In one aspect of this embodiment, the cleaning liquid has a high vapor pressure so that it evaporates quickly, leaving the rear surface 119 dry before the post-operative portion 114 of the polishing pad 116 returns to the platen 120. For example, the cleaning liquid can include acetone, alcohol, or other liquids having a relatively high vapor pressure. Alternatively, the vapor pressure of the cleaning liquid may not be particularly high and the rate at which the polishing pad 116 moves back onto the platen 120 can be reduced (or the polishing pad 116 can remain in a fixed position) while the cleaning liquid evaporates from the rear surface 119.

In one embodiment, the cleaning head 150 includes one or more gas manifolds 160 to hasten the drying of the rear surface 119 and/or to clean the rear surface 119. In one aspect of this embodiment, the cleaning head 150 has three gas manifolds 160 (shown as an upper manifold 160*a,* an intermediate manifold 160*b* and a lower manifold 160*c*) and in other embodiments, the cleaning head has more or fewer manifolds 160, as will be discussed in greater detail below. Each gas manifold 160 is coupled via a gas conduit or passage 161 to a gas source 164 to provide gas to the manifolds 160. The gas source 164 can include any suitable gas, such as air, or an inert gas, compressed to an elevated pressure of, for example, between about 10 psi and about 100 psi, or another suitable pressure.

Each gas manifold 160 is also in fluid communication with one or more orifices 162 (shown in FIG. 2 as circular upper orifices 162*a,* circular intermediate orifices 162*b* and an elongated lower orifice 162*c*) to direct the gas toward the rear surface 119 of the polishing pad 116. The upper and intermediate orifices 162*a,* 162*b* can include discrete circular openings arranged in rows transverse to the travel direction T—T of the polishing pad 116 or the orifices 162*a,* 162*b* can have other shapes or configurations. In one embodiment, the upper orifices 162*a* are offset or staggered transversely relative to the intermediate orifices 162*b* to uniformly distribute the gas over the width of the rear surface 119. In one aspect of this embodiment, the orifices 162*a,* 162*b* are directed at least partially downward so that the gas emitted from the orifices 162*a,* 162*b* forces liquid and/or contaminants downwardly away from the rear surface 119 as the post-operative portion 114 moves upwardly back onto the platen 120. Alternatively, the orifices 162*a,* 162*b* can have other orientations.

In yet a further aspect of this embodiment, the lower orifice 162*c* includes a slot elongated in a direction generally transverse to the travel path T—T and directed at least slightly downward, as was discussed above. The lower gas manifold 160*c* is coupled to a temperature controller 163 to control the temperature of the gas directed toward the rear surface 119 of the polishing pad 116. For example, in one embodiment, the temperature controller 163 can control the temperature of the gas be up to and including approximately 100° C. In other embodiments, the temperature controller 163 can elevate the temperature of the gas to other values that do not adversely affect the polishing pad 116.

In still further embodiments, other combinations and arrangements of the elements discussed above with reference to FIG. 2 can clean and/or dry the rear surface 119 of the polishing pad 116. For example, the cleaning head 150 can include a single row of orifices 162 or can include more than two rows of orifices 162, any of which can be coupled to the temperature controller 163. Alternatively, the cleaning head 150 can include the elongated orifice 162*c* in lieu of, rather than in addition to, the circular orifices 162*a,* 162*b*. In another embodiment, the gas manifold(s) 160 can be eliminated, for example, when the liquid manifold 170 provides liquid sufficient to adequately clean the rear surface 119 of the polishing pad 116 and the liquid evaporates before the post-operative portion 114 moves back onto the platen 120. Conversely, when the gas provided by the gas manifold (s) 160 is sufficient to both clean and dry the rear surface 119, the liquid manifold 170 can be eliminated.

One feature of an embodiment of the apparatus 110 discussed above with reference to FIG. 2 is that the cleaning head 150 removes liquid and/or solid contaminants from the rear surface 119 of the polishing pad 116 before the post-operative portion 114 of the polishing pad 116 returns to the platen 120. An advantage of this arrangement is that the planarizing surface 118 of the polishing pad 116 is less likely to have non-uniformities resulting from contaminants trapped between the polishing pad 116 and the support pad 111. A further advantage of this arrangement is that the likelihood for the polishing pad 116 to adhere to the support pad 111 (due to the presence of liquid between the two) can be reduced, increasing the ease with which the polishing pad 116 is moved across the platen 120. This is unlike some conventional planarizing devices which not only allow liquid and/or solid debris to accumulate on the rear surface 119 of the polishing pad 116 but also fail to remove such contaminants before the polishing pad 116 returns to the platen 120.

Figure 3:
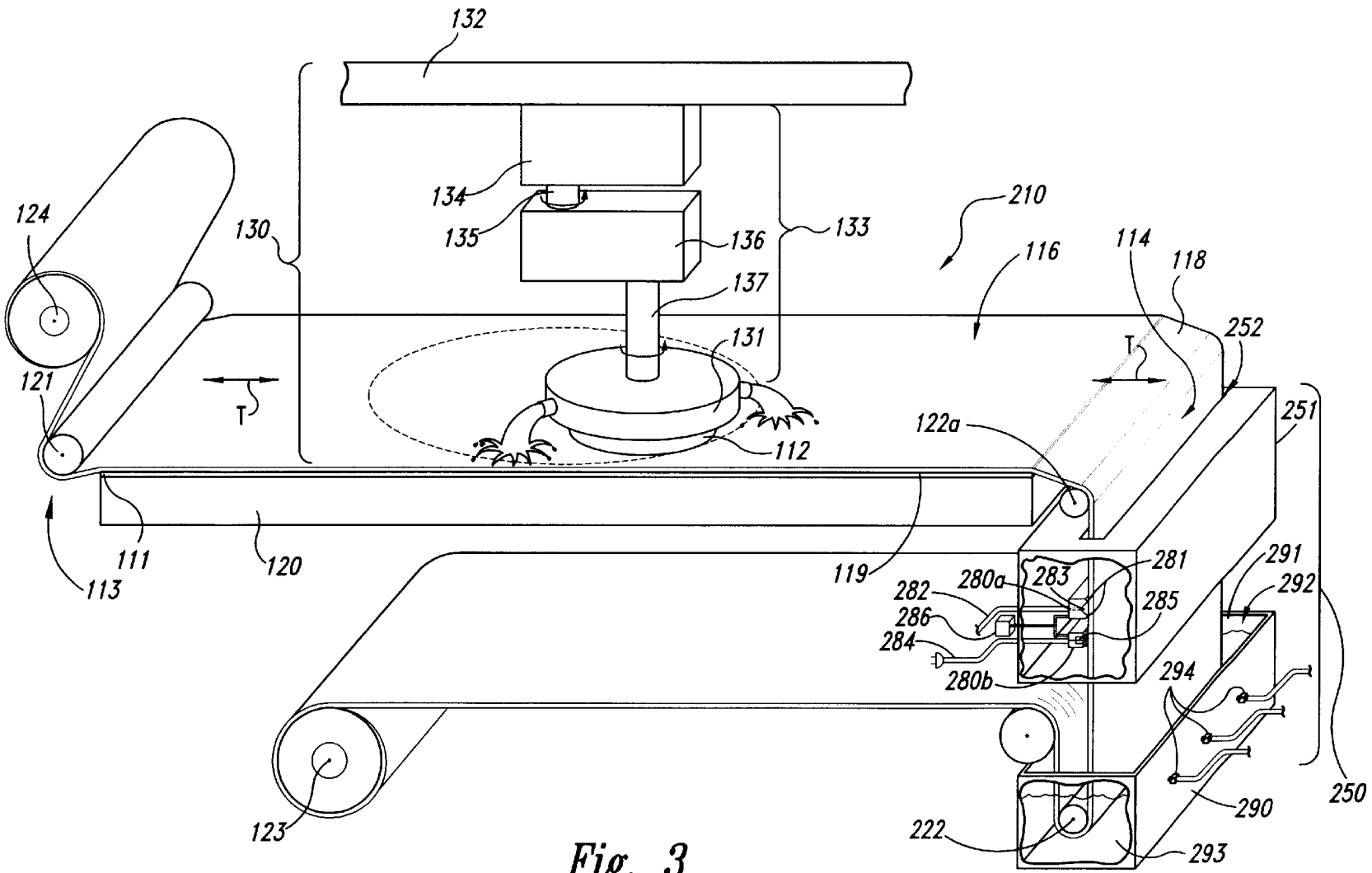
FIG. 3 is a partially schematic, partially broken, front isometric view of a planarizing machine having a cleaning head and a liquid vessel in accordance with another embodiment of the invention.

FIG. 3 is a partially schematic, partially broken side isometric view of an apparatus 210 having a cleaning head 250 in accordance with another embodiment of the invention. The cleaning head 250 includes a body 251 having a slot 252 through which the polishing pad 116 passes. In one embodiment, two contact elements 280 (shown as a wiper 280*a* and an absorbent brush 280*b*) are positioned within the slot to remove contaminants from the rear surface 119 of the polishing pad 116. The contact elements 280 can be coupled to an actuator 286 that moves the contact elements 280 into and out of engagement with the rear surface 119, or the contact elements 280 can remain pressed against the rear surface 119. In other embodiments, the cleaning head 250 can include more or fewer contact elements 280 and/or contact elements 280 in combination with fluid manifolds and/or gas manifolds, similar to those discussed above with reference to FIG. 2.

In one embodiment, the wiper 280*a* includes an impermeable, resilient and flexible material, such as rubber or another elastomer having one or more edges 281 (two are shown in FIG. 3) or other cleaning surfaces that contact the rear surface 119 of the polishing pad 116. In a further aspect of this embodiment, the wiper 280*a* has vacuum orifices 283 facing toward the rear surface 119 and coupled with a vacuum conduit 282 to a vacuum source (not shown). When a vacuum is applied to the vacuum orifices 283 via the vacuum conduit 282, the polishing pad 116 is drawn against the wiper 280*a* so that the rear surface 119 contacts the edges 281, forming an at least partially liquid-tight seal. Alternatively, the vacuum orifices 283 can be housed in a separate unit (not shown) adjacent to the wiper 280*a*. In either case, the edges 281 of the wiper 280*a* deflect liquid and/or solid contaminants from the rear surface 119 as the polishing pad 116 moves upwardly onto the platen 120.

The cleaning head 250 can include the absorbent brush 280*b* in addition to, or in lieu of the wiper 280*a*. In one embodiment, the absorbent brush 280*b* has a cleaning surface that includes any resilient, compliant and absorbent material (such as polyvinyl alcohol) to absorb liquid from the polishing pad 116 without abrading the polishing pad 116. In one aspect of this embodiment, the absorbent brush

280*b* has a heating element 285 coupled to an electrical source (not shown) with electrical leads 284 to remove moisture from the absorbent brush 280*b* after the absorbent brush 280*b* has absorbed moisture from the rear surface 119 of the polishing pad 116. In other embodiments, other devices (for example, rollers or forced heated air) discharge moisture from the absorbent brush 280*b*. In still another embodiment, the absorbent brush 280*b* (or another contact element 280, such as the wiper 280*a*) is heated while it is pressed against the polishing pad 116.

In yet another embodiment, the cleaning head 250 includes the heating element 285 alone instead of the contact elements 280. For example, the heating element 285 can include an electric coil heater or an infrared heater that removes moisture from the rear surface 119 of the polishing pad without contacting the polishing pad 116. In one embodiment, the heating element 285 operates in conjunction with devices that clean the rear surface 119 (such as the gas manifolds 160 and liquid manifolds 170 discussed above with reference to FIG. 2) or alternatively the heating element 285 operates independently of the cleaning devices, for example, when it is desired only to dry the rear surface 119, rather than both clean and dry the rear surface 119.

In one embodiment, the cleaning head 250 includes a cleaning vessel 290 in addition to or in lieu of the planarizing surface cleaner 140 discussed above with reference to FIG. 2. The cleaning vessel 290 has an internal volume 292 with an opening 291 configured to receive the polishing pad 116. The internal volume 292 contains a cleaning liquid 293, such as a solvent, to remove contaminants from the polishing pad 116. In one aspect of this embodiment, the polishing pad 116 passes around a guide roller 222 submerged in the cleaning liquid 293 to immerse both the planarizing surface 119 and the rear surface 118 of the polishing pad 116. Alternatively, the cleaning vessel 290 can include other devices that immerse the planarizing surface 118 and/or the rear surface 119. The vessel 290 can also include ultrasonic transducers 294 adjacent to the internal volume 292 to direct ultrasonic energy into the cleaning liquid 293, increasing the efficacy of the cleaning liquid 293.

In one embodiment, the cleaning liquid 293 includes a relatively high vapor pressure liquid, such as acetone or alcohol, that evaporates from the polishing pad 116 before the post-operative portion 114 of the polishing pad 116 returns to the platen 120. Accordingly, the body 251 of cleaning head 250 can be eliminated. Alternatively, the vessel 290 can include other liquids 293 (such as water) that do not evaporate as readily as acetone or alcohol, in which case the contact elements 280, the heating element 285, and/or the gas manifolds 160 discussed above can remove excess liquid from the rear surface 119 of the polishing pad 116 before the polishing pad 116 returns to the platen 120.

One feature of an embodiment of the apparatus 210 shown in FIG. 3 is that the cleaning vessel 290 cleans the polishing pad 116 without direct mechanical contact other than that resulting from the roller 222. Accordingly, the likelihood for abrading the polishing pad 116 during cleaning is reduced when compared with some conventional devices. The likelihood for abrasion can be further reduced by drying the polishing pad 116 with the heater 285 or with gas from the gas manifold(s) 160 (FIG. 2) or by allowing the cleaning liquid 293 to evaporate before the polishing pad 116 returns to the platen 120.

Figure 4:
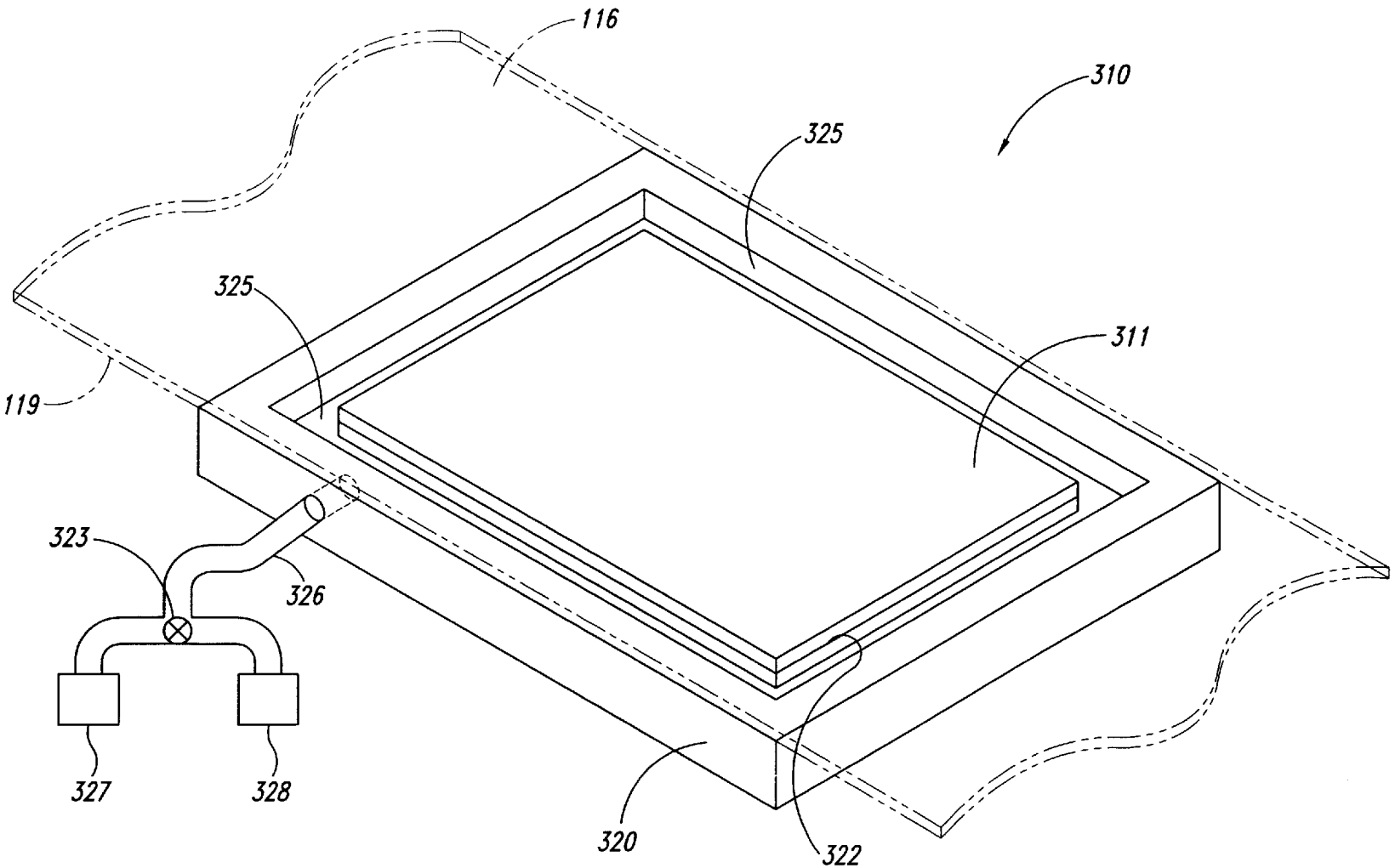
FIG. 4 is a partially schematic, top isometric view of a portion of a planarizing machine having a platen coupled to a gas source and a vacuum source in accordance with another embodiment of the invention.

FIG. 4 is a partially schematic, top isometric view of a portion of a planarizing apparatus 310 having a platen 320 that supports the polishing pad 116 (shown in phantom lines) in accordance with another embodiment of the invention. In one aspect of this embodiment, the apparatus 310 includes a support pad 311 positioned between the rear surface 119 of the polishing pad 116 and an upwardly facing support surface 322 of the platen 320. The platen 320 can further include a channel 325 that extends around the perimeter of the support pad 311 and has an upwardly facing opening adjacent to the rear surface 119 of the polishing pad 116. The channel 325 is coupled with a conduit 326 to a pressurized gas source 327 and a vacuum source 328. A valve 323 in the conduit 326 can be manually or automatically controlled to connect either the gas source 327 or the vacuum source 328 with the channel 325.

In operation, the valve 323 is adjusted to connect the vacuum source 328 with the channel 325 during planarization of the substrate 112 (FIGS. 2–3). Accordingly, the polishing pad 116 is drawn tightly against the support pad 311 to prevent unwanted movement of the polishing pad 116 which can result in non-uniformities in the substrate 112. When the polishing pad 116 is to be moved relative to the platen 320 (for example, to be cleaned according to one or more of the methods discussed above with reference to FIGS. 2–3), the valve 323 is adjusted to couple the gas source 327 to the channel 325. The gas source 327 pumps a gas (such as air) through the channel 325 to impinge on the rear surface 119 of the polishing pad 116 and flow to an interface region between the polishing pad 116 and the support pad 311. The pressurized gas separates the polishing pad 116 slightly from the support pad 311, allowing the polishing pad 116 to be more easily moved relative to the support pad 311 and the platen 320. Furthermore, the compressed gas can remove contaminants, such as liquid or solid debris, from the rear surface 119 of the polishing pad 116. Accordingly, an advantage of an embodiment of the apparatus 310 shown in FIG. 4 is that it can clean and dry the rear surface 119 and/or separate the rear surface 119 from the support pad 311 for moving the polishing pad 116 relative to the platen 320.

Figure 5:
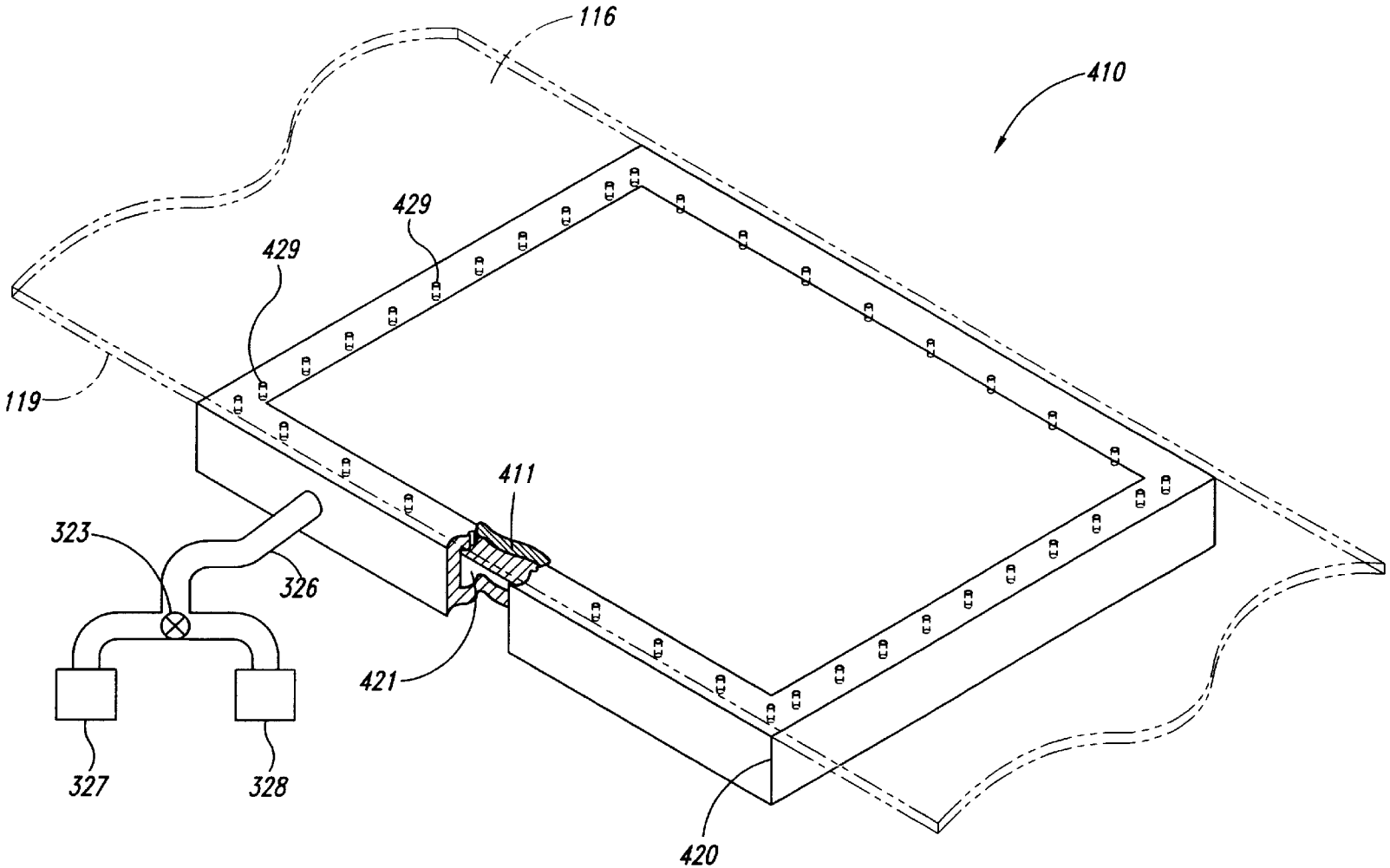
FIG. 5 is a partially schematic, top isometric view of a portion of a planarizing machine having a platen with orifices coupled to a gas source and a vacuum source in accordance with another embodiment of the invention.

FIG. 5 is a partially schematic, partially broken top isometric view of a portion of a planarizing apparatus 410 having a platen 420 and a support pad 411 that support the polishing pad 116 in accordance with another embodiment of the invention. The platen 420 includes a plurality of orifices 429 arranged around the perimeter of the support pad 411 and coupled to a plenum 421 positioned within the platen 420. The plenum 421 is coupled via the conduit 326 to the gas source 327 and the vacuum source 328 in a manner generally similar to that discussed above with reference to FIG. 4. Accordingly, the plenum 421 can be selectively coupled to the gas source 327 and the vacuum source 328 to either expel or draw in air in a manner generally similar to that discussed above with reference to FIG. 4.

Figure 6:
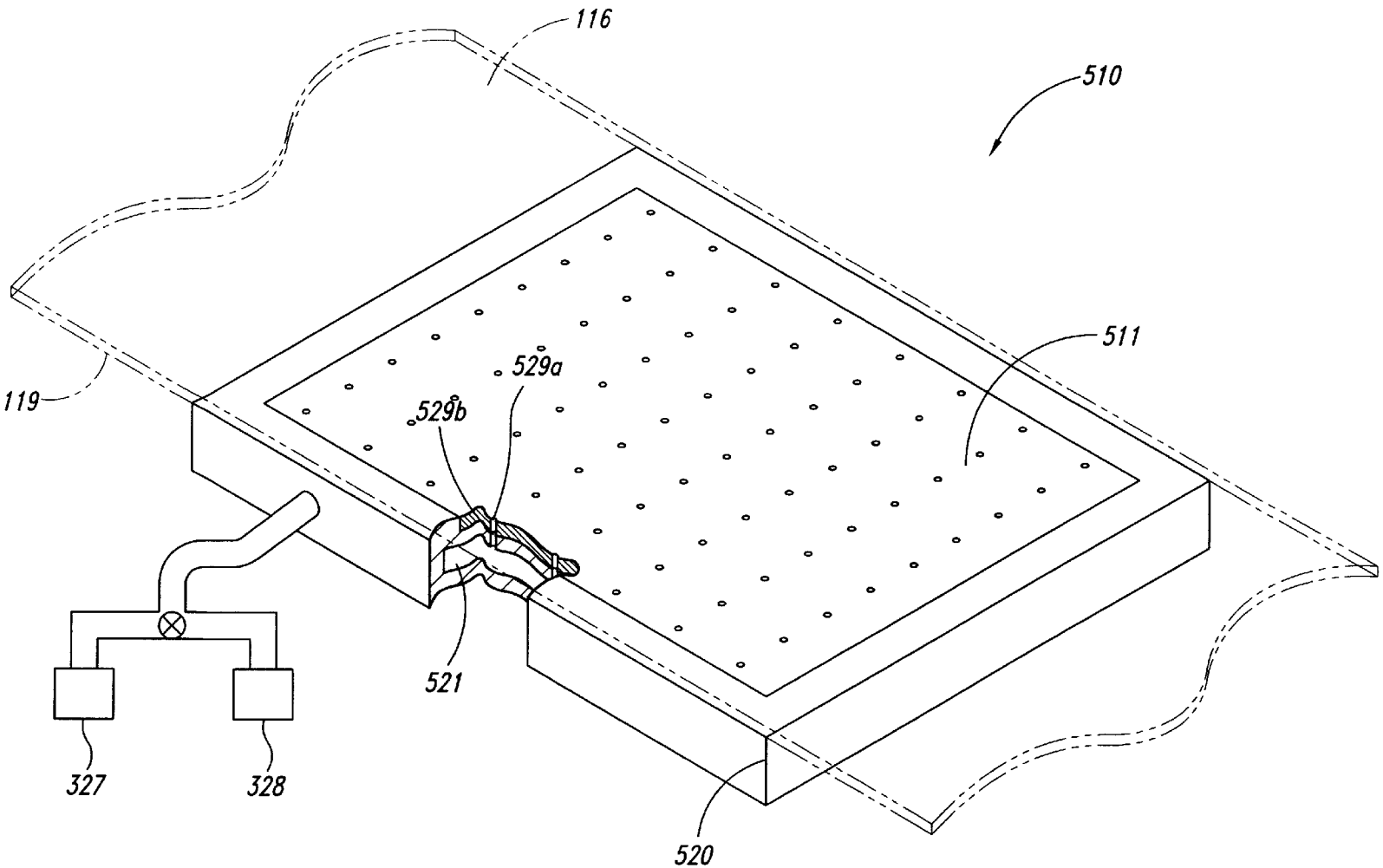
FIG. 6 is a partially schematic, top isometric view of a portion of a planarizing machine having a platen and a support pad with orifices coupled to a gas source and a vacuum source in accordance with still another embodiment of the invention.

FIG. 6 is a partially schematic, partially broken top isometric view of a portion of an apparatus 510 having a platen 520 and a support pad 511 that support the polishing pad 116 in accordance with yet another embodiment of the invention. The platen 520 includes a plenum 521 coupled to the gas source 327 and the vacuum source 328 in a manner similar to that discussed above. The apparatus 510 further includes a plurality of orifices 529, including pad orifices 529*a* extending through the support pad 511 and aligned with a corresponding plurality of platen orifices 529*b* extending through a portion of the platen 520 to be in fluid communication with the manifold 521. The orifices 529 can be uniformly spaced over the support pad 511, or alternatively, the orifices can be arranged in other patterns. In a further aspect of this embodiment, the orifices 529 can point toward the edges of the support pad 511 and the polishing pad 116 to direct contaminants outwardly away from the interface region between the support pad 511 and the polishing pad 116. The orifices 529 are selectively coupled to either the gas source 327 or the vacuum source 328 to operate in a manner similar to that discussed above with reference to FIG. 4.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. An apparatus for removing material from a rear surface of an elongated polishing pad, the polishing pad having a planarizing surface opposite the rear surface to planarize a microelectronic substrate, the polishing pad extending across a platen and having a post-operative portion movable relative to the platen, the apparatus comprising a cleaning head positioned proximate to the post-operative portion of the polishing pad and having at least one cleaning device operable to remove material from the rear surface of the post-operative portion of the polishing pad.

2. The apparatus of claim 1 wherein the cleaning device includes a contact element having a cleaning surface positionable to contact the rear surface of the post-operative portion of the polishing pad.

3. The apparatus of claim 1 wherein the cleaning device includes an orifice coupleable to a fluid source and facing at least partially toward the rear surface of the polishing pad to direct fluid toward the rear surface of the polishing pad and remove material from the rear surface.

4. The apparatus of claim 1 wherein the cleaning device includes a vessel positioned proximate to the post-operative portion of the polishing pad and having an opening configured to receive the post-operative portion of the polishing pad, the vessel having an interior volume in fluid communication with the opening and configured to contain a quantity of cleaning liquid sufficient to contact the rear surface of the polishing pad.

5. The apparatus of claim 1 wherein the polishing pad extends from a supply roll across the platen to a take-up roll and the cleaning head includes a body having a first surface toward the platen, a second surface toward the take-up roll and a slot extending through the body from the first surface to the second surface to receive the polishing pad, the body further having a manifold coupled to the fluid source and coupled to a plurality of orifices positioned within the slot, each orifice being directed toward the rear surface of the post-operative portion of the polishing pad.

6. The apparatus of claim 1 wherein the polishing pad moves back and forth across the platen between a supply roll and a take-up roll along a travel axis, further wherein the cleaning head includes a body having a first surface toward the platen, a second surface toward the take-up roll, and a slot aligned with the travel axis and extending through the body from the first surface to the second surface to receive the polishing pad, the body further having a manifold coupled to the fluid source and coupled to a plurality of orifices positioned within the slot, the orifices being arranged in at least one row oriented transverse to the travel axis, each orifice being directed toward the rear surface of the post-operative portion of the polishing pad.

7. The apparatus of claim 1 wherein the polishing pad moves back and forth across the platen between a supply roll and a take-up roll along a travel axis, further wherein the cleaning head includes a plurality of orifices arranged in first and second rows oriented transverse to the travel axis, orifices of the first row being offset in a direction transverse to the travel axis from orifices of the second row, the orifices of both the first and second rows being coupled to a source of heated gas to remove liquid from the rear surface of the polishing pad by evaporation.

8. The apparatus of claim 1 wherein the polishing pad moves back and forth across the platen between a supply roll and a take-up roll along a travel axis and the cleaning head has an orifice coupleable to a fluid source and facing at least partially toward the rear surface of the polishing pad, the orifice including a slot elongated along an axis generally transverse to the travel axis.

9. The apparatus of claim 1 wherein the cleaning head has an orifice facing at least partially toward the rear surface of the polishing pad and coupled to a source of high vapor pressure liquid.

10. The apparatus of claim 9 wherein the high vapor pressure liquid is selected from alcohol and acetone.

11. The apparatus of claim 1 wherein the cleaning head has an orifice facing at least partially toward the rear surface of the polishing pad and coupled to a source of gas.

12. The apparatus of claim 11 wherein the gas has a pressure of from approximately 10 to approximately 100 psi.

13. The apparatus of claim 11 wherein the source of gas includes air.

14. The apparatus of claim 1 wherein the cleaning head has an orifice facing at least partially toward the rear surface of the polishing pad and coupleable to a fluid source, further comprising a temperature controller in fluid communication with the orifice to control a temperature of fluid passing through the orifice.

15. The apparatus of claim 14 wherein the temperature controller is configured to control the temperature of fluid passing through the orifice to be less than approximately 100 degrees Celsius.

16. The apparatus of claim 1 wherein the polishing pad moves back and forth across the platen between a supply roll and a take-up roll along a travel axis, further wherein the cleaning head has a contact element with the cleaning surface positionable to contact the rear surface of the post-operative portion of the polishing pad, the contact element including a generally impermeable blade elongated along an axis transverse to the travel axis and positionable to press against the polishing pad and form an at least approximately liquid tight seal with the polishing pad to remove liquid from the polishing pad as the polishing pad moves relative to the cleaning surface.

17. The apparatus of claim 1 wherein the cleaning head has a contact element with a cleaning surface positionable to contact the rear surface of the post-operative portion of the polishing pad, the contact element including an absorbent brush.

18. The apparatus of claim 17 wherein the absorbent brush is coupled to a heating element to discharge liquid absorbed by the absorbent brush.

19. The apparatus of claim 1, further comprising a vacuum source in fluid communication with the polishing pad to draw the polishing pad against the cleaning surface of the contact element.

20. The apparatus of claim 1 wherein the cleaning head has a plurality of cleaning surfaces, each being positionable to contact the rear surface of the polishing pad to remove material from the rear surface.

21. The apparatus of claim 1 wherein the cleaning head has a first orifice in fluid communication with a source of pressurized gas and a second orifice in fluid communication with a source of cleaning liquid, the first and second orifices being directed toward the rear surface of the polishing pad.

22. The apparatus of claim 1 wherein the cleaning head has a heat source positioned proximate to the rear surface of the post-operative portion of the polishing pad to direct heat toward the rear surface of the polishing pad and dry the rear surface.

* * * * *